US006135846A

United States Patent [19]

Young

[11] Patent Number: 6,135,846

[45] Date of Patent: Oct. 24, 2000

[54] COVERTLY OPERATED TOY TALKING PARROT

[76] Inventor: Gordon Young, 1270 Champion Cir., Carrollton, Tex. 75006

[21] Appl. No.: 09/250,143

[22] Filed: Feb. 16, 1999

[51] Int. Cl.[7] ..... A63H 3/28; A63H 30/00; A63H 33/00

[52] U.S. Cl. ..... 446/302; 446/175; 446/26

[58] Field of Search ..... 446/175, 297, 446/299, 301, 302, 303, 319, 370, 371, 372, 901, 26

[56] References Cited

U.S. PATENT DOCUMENTS

| | | | |
|---|---|---|---|
| 2,941,380 | 6/1960 | Coulter | 446/303 |
| 3,131,497 | 5/1964 | Rogers | 446/302 |
| 4,543,669 | 10/1985 | Kaz | 446/369 X |
| 4,687,457 | 8/1987 | Milner | 446/303 X |
| 4,913,676 | 4/1990 | Koguchi et al. . | |
| 4,979,921 | 12/1990 | Cardillo | 446/26 |
| 5,316,516 | 5/1994 | Saitoh | 446/175 |

FOREIGN PATENT DOCUMENTS

| | | | |
|---|---|---|---|
| 2737177 | 8/1977 | Germany | 446/303 |

*Primary Examiner*—D. Neal Muir
*Attorney, Agent, or Firm*—Myron Amer PC

[57] ABSTRACT

A method of operating a toy parrot of a known type, as illustrated and described in U.S. Pat. No. 4,913,676, having a voice-recording and a recorded voice-playback mechanism in the operation of which the playback of the previously recorded voice, namely that of the user, is initiated from a covert location, such as a pocket of the user, so that a listener is taken by surprise by the playback which significantly contributes to the play value of the toy parrot.

2 Claims, 1 Drawing Sheet

COVERTLY OPERATED TOY TALKING PARROT

The present invention relates generally to improvements for a known toy parrot of a type having voice recording and recorded voice playback functioning, the referenced toy parrot being illustrated and described in prior patents, as exemplified by U.S. Pat. No. 4,913,676, and more particularly to improvements which use to greater advantage the noted recording and playback functioning to significantly contribute to the novelty value of the toy parrot.

BACKGROUND OF THE INVENTION

Field of the Invention

The toy animal of U.S. Pat. No. 4,913,676 for "Moving Animal Toy" issued to Koguchi et al. on Apr. 3, 1990 was undoubtedly selected to be in the specific form or likeness of a parrot since it is known by common experience that a parrot can be trained to utter sounds that simulate adult speech. Thus, in the '676 patent and in similar toy parrot prior patents, it is the practice to house within the toy parrot a voice recording and a recorded voice playback mechanism to achieve simulated adult speech in the play mode of the parrot. However, bemusement of the user is unnecessarily limited to the surprise of hearing simulated adult speech emanating from the toy parrot and also that the simulated adult speech is in a recognized voice, i.e., the voice of the user.

SUMMARY OF THE INVENTION

Broadly, it is an object of the present invention to overcome the foregoing and other limited play value shortcomings of the prior patented "talking" toy parrots.

More particularly, it is an object to significantly enhance the "talking" function of the prior art parrots to an extent contributing to establishing a conversation between a user and a listener, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

DESCRIPTION OF THE PREFERRED EMBODIMENT

Figure 1:
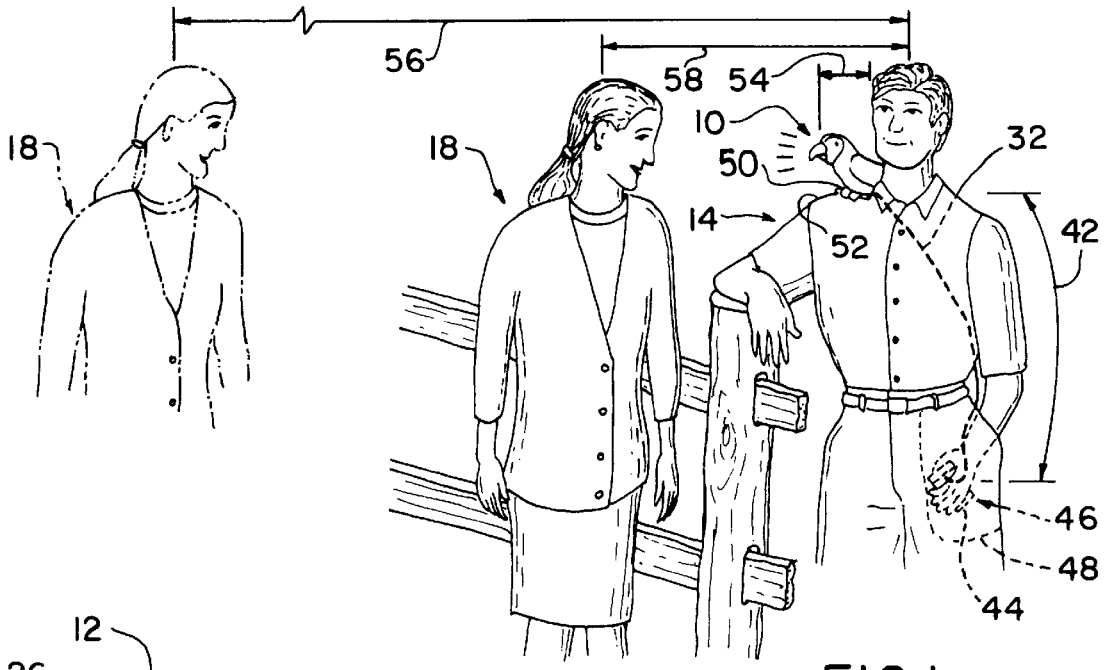
FIG. 1 is a perspective view of a play value-enhanced method of using a toy parrot having a voice recording and recorded voice playback operating mode.
Figure 3:
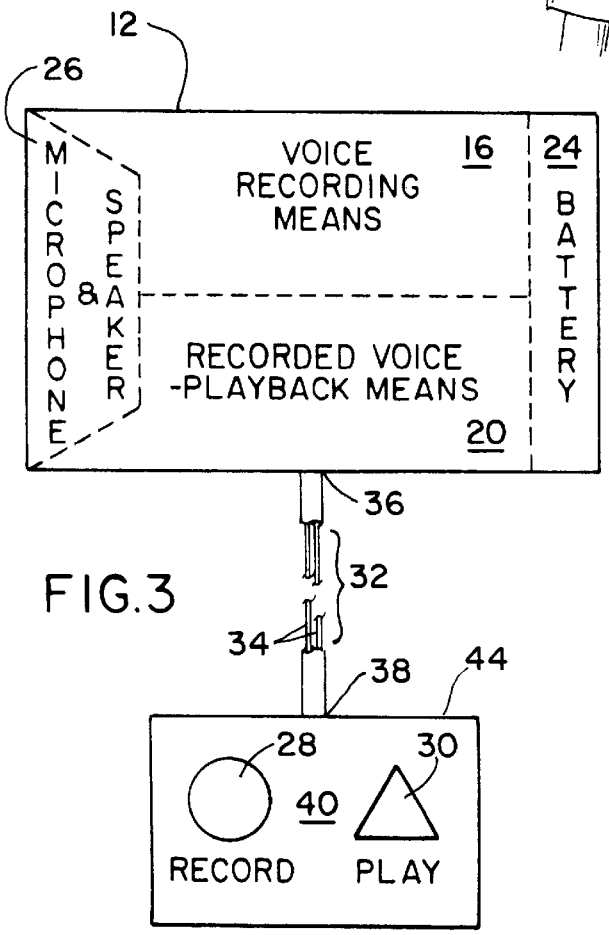
FIG. 3 is a block diagram of a known voice recording and recorded voice playback mechanism and also a hitherto unknown use of a remote controller for the toy parrot.
Figure 2:
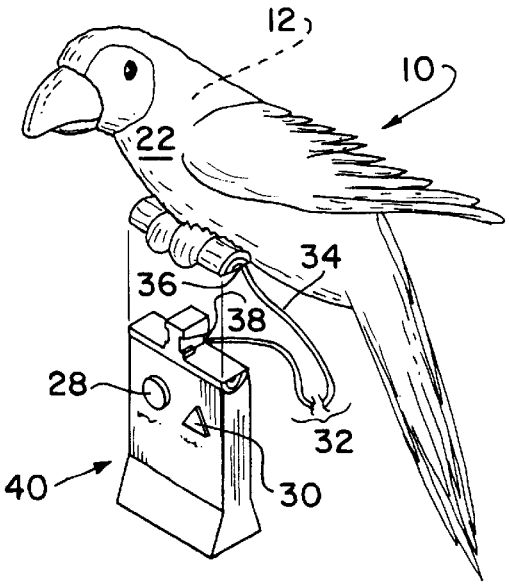
FIG. 2 is an isolated perspective view of the toy parrot of FIG. 1.

It is already known from U.S. Pat. No. 4,913,676 for "Moving Toy Animal" of Koguchi et al. issued on Apr. 3, 1990 about a toy parrot 10 having a voice recording and recorded voice playback mechanism, generally designated 12 having a known operating mode, as described and illustrated in detail in U.S. Pat. No. 4,913,676, of which the referenced said description and illustration is incorporated herein in its entirety by this reference. The operating mode contemplated for the '676 parrot, which it will be understood is so similar to the within inventive parrot 10 as to be aptly also designated by the reference numeral 10, is to have a user 14 record in the user's voice a message such as "polly wants a cracker" using voice recorded means 16, and playing back to a listener 18 using a recorded voice playback means 20 the recorded message, i.e. "polly wants a cracker," to the amusement of the listener 18 in part because the playback is in the recognized voice of the user 14.

The voice recording and recorded voice playback mechanism 12, as known from the '676 Patent, that is housed within the body 22 of the toy parrot 10 is operated by a battery 24 and broadcast through a combination, generally designated 26, consisting of a microphone, for recording, and speaker, for broadcasting. Buttons initiating the recording at 28, and playback at 30, will be understood to be positioned in clear view on the parrot body 22, a position not shown in the application drawing figures, it being important to note that in said FIG. 1 the position is remote from the toy parrot 10, as permitted by the length 32 of an electrical conductor 34 connected at a proximal end 36 to the internal voice recording and recorded voice playback mechanism 12 and connected at a distal end 38 to the housing 40 of the recording button 28 and playback button 30, the span between the proximal and distal ends 36, 38 or length 32 of the electrical conductor 34 being a typical arm's length 42 of the user 14 which enables, as intended in accordance with the present invention, the positioning of housing 44 serving as a remote controller for the internal parrot mechanism 12 in a covert location, as at 46, which could be in the trouser pocket 48 of the user 14.

The method of both the '676 and the within inventive parrots 10 is initiated by providing a perching position, as at 50, on the shoulder 52 of the user 14, which is at a distance 54 close enough for message recording purposes. A significant difference in the practice of this method step as between the parrots is that with the '676 parrot the pressed button 28 being in clear view on the parrot body 22 is likely to be noticed by the listener, whereas it is less likely and, in fact, almost is never noticed in the use of the within inventive parrot 10 because the pressed button 28 is out of view.

The recording function is recommended when the listener 18 is at a remote location from the user 14, as at 56, and approaching the user 14, the distance between location 56 and the position of the user 14 being aptly characterized as being out of earshot. A message contributing to the novelty value of the parrot 10, and taking to account a gender difference between the user and listener 14, 18 is "Good morning. You look wonderful."

When the listener 18 and user 14 are within earshot, as at 58, and as depicted in full like perspective in FIG. 1, it is an opportune circumstance to press the playback button 30 without detection which in practice is of observed noticeable amusement to the listener 18.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A method of enhancing the play value of a toy parrot of a type having a voice recording and a recorded voice playback mechanism, said method comprising the steps of perching said toy parrot on a shoulder of a user so as to be in voice-recording range, using a selected length of an electrical conductor having a distal end and a proximal end, attaching said electrical conductor distal end to said voice recording and recorded voice playback mechanism so as to have an extending length thereof available for positioning, attaching a voice recording and recorded voice playback switch means to said proximal end of said electrical conductor, selecting a length of said electrical conductor of not less than an arms' length of a user, and positioning said electrical conductor-attached said voice recording and recorded voice playback switch means to the extent permitted by said length thereof in a selected covert location on said user, whereby in the use of said voice recording and recorded voice playback switch means a user is able without detection to record and cause playback of a voice message, the former out of earshot of an individual and the latter within earshot.

2. A method of enhancing the play value of a toy parrot as claimed in claim 1 including the step of selecting a trouser pocket of a user as the covert location of the voice recording and recorded voice playback switch.

* * * * *